United States Patent [19]

Stilling

[11] Patent Number: 4,516,343

[45] Date of Patent: May 14, 1985

[54] SIGN STRUCTURE

[76] Inventor: Johann Stilling, Apt. #A1001, 1141 Royal York Rd., Islington, Ontario, Canada

[21] Appl. No.: 458,771

[22] Filed: Jan. 18, 1983

[51] Int. Cl.[3] ..... G09F 13/04

[52] U.S. Cl. ..... 40/574; 40/549; 40/564; 40/578; 40/603

[58] Field of Search ..... 40/549, 575, 574, 564, 40/603, 572, 578; 38/102.91; 160/391, 395, 398; 16/355, 365

[56] References Cited

U.S. PATENT DOCUMENTS

| | | | |
|---|---|---|---|
| 3,863,372 | 2/1975 | Stilling | 40/549 |
| 4,265,039 | 5/1981 | Brooks | 40/549 |
| 4,370,792 | 2/1983 | Watts | 160/392 |
| 4,452,000 | 6/1984 | Gandy | 40/603 |

*Primary Examiner*—Robert P. Swiatek
*Assistant Examiner*—Cary E. Stone

[57] ABSTRACT

An intermediate frame construction for use in association with a sign box of the type having a box hinge recess around its perimeter and a front frame for supporting a face panel, the front frame having a front hinge, the intermediate frame comprising, a generally rectangular frame having two end members, and top and bottom members, joining one another at corners, each of the members having an outer wall, face panel support connected with the outer wall and extending inwardly for supporting a face panel therein, an intermediate hinge connected to the outer wall, and extending in a rearward direction for hinging interengagement with the box hinge recess in the sign box, and, a wall defining an intermediate hinge recess connected to the outer wall, and extending in a forward direction, and adapted to receive the front hinge carried on the front frame whereby such front frame is hingedly connected to such intermediate frame, and such intermediate frame is in turn hingedly connected to such sign box.

6 Claims, 6 Drawing Figures

SIGN STRUCTURE

The invention relates to illuminated signs of the type having a fixed box portion, and a moveable face panel, and in particular to the construction of the face frame of the sign.

Sign box construction using extruded components for the sign box, and the face frame, is disclosed in U.S. Pat. No. 3,863,372. This form of construction has proved to be highly satisfactory in practice and is in wide use. The sign face panel usually formed of plastic material is supported in the face frame. The face frame is then hingedly mounted on the fixed portion of the box, which contains the lighting.

There are however cases where variations are required in the type of sign face. For example, in some cases it is desireable to provide a composite sign face having two spaced apart plastic panels. One plastic panel bears information which is constant, and the other sign panel may bear information which can be changed at intervals.

In some other cases it is desireable to fabricate the sign face out of thin sheet plastic material, rather than the usually relatively thick rigid plastic material that has been used in the past. The thin sheet material has certain advantages from the view point of economy and is also somewhat easier to print. Support systems for such flexible material have been proposed in U.S. Pat. No. 4,265,039, but are unnecessarily complex.

For these reasons it is desireable to provide a modified form of face frame, so that different such faces may be provided without changing the design of the fixed part of the sign.

It is also desireable to provide a face frame which is suitable for the mounting of a thin flexible sheet sign face, without changing the design of the sign box.

In the present invention these two objectives are achieved in a single component which may be used for either purpose. Clearly, however, two separate components could be made, one to meet each objective. It is intended that the invention may be practised in both ways, i.e., using a single dual-purpose component, or using two components, one for each purpose.

In one embodiment therefore that invention will be seen to comprise an intermediate face frame adapted to be located between the outer face frame and the sign box. The intermediate face frame has a first hinging portion adapted to be hingedly mounted on a first hinging member on the sign box, and is also provided with a second hinging member so that it is adapted to provide a hinge mounting for a second hinging portion on the outer face frame. The intermediate face frame is adapted to carry an intermediate face panel, and the outer face frame is adapted to carry an outer face panel. In this way, the intermediate face frame can be placed in position on the box and fastened, and the outer face frame can then be hingedly mounted on the front of the intermediate face frame, and also fastened.

In one embodiment of the invention the second hinging member on the intermediate face frame is also adaptable for use with the thin flexible sheet plastic face panel material. In this embodiment the invention is of course used without the outer face frame at all. In this embodiment, the mounting of the thin sheet material to the intermediate face frame is achieved by a core member which is adapted to receive an edge of the thin sheet material, and will then provide a core on which such material may be folded or wound. Such core member is then located in a suitable groove or recess in the intermediate face frame.

It will however be appreciated that the invention also envisages the provision of a face frame which is particularly adapted to the mounting of thin flexible sheet material, and which is provided with a suitable groove for cooperation with such thin sheet material, and core member, and need not in this case be also adaptable for any other purpose. In this case, the face frame for the thin sheet material would not have to be provided with the second hinging member but would simply be provided with any suitable form of groove or channel in which the thin sheet material and core member may be received.

The invention also comprises the provision of a core member for fastening and supporting thin sheet face panel material on a face frame.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 1:
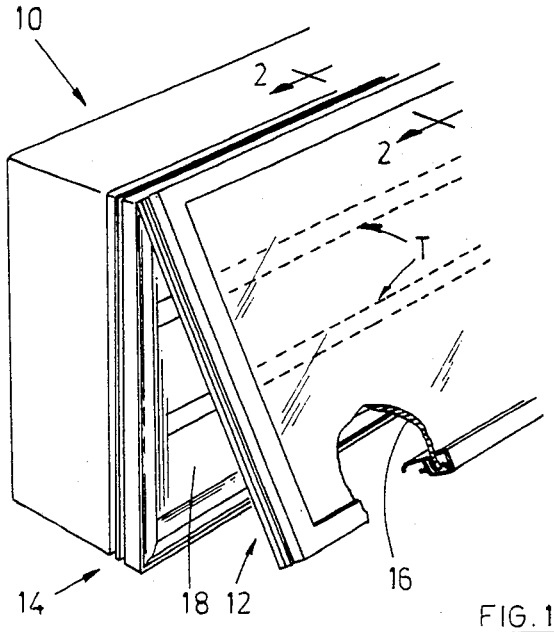
FIG. 1 is a perspective illustration showing a portion of a sign box, having an intermediate face frame and outer face frame mounted thereon, in accordance with one embodiment of the invention.

As best shown in FIG. 1, the invention relates to illuminated signs, usually outdoor signs, although they may also be used indoors, such signs typically being used on store fronts and the like. Such signs may be mounted directly on the store front, or may be mounted free standing on a post, or some other form of supports, and may have a single face giving information or may have two faces one on either side.

For the sake of simplicity a single face sign is illustrated, but it will of course be appreciated that a double faced sign could equally well be made in the same way.

Again as shown in FIG. 1 such an illuminated sign will be seen to comprise a fixed sign box portion 10 and an outer face frame 12, and is further provided with an intermediate face frame 14, located between the outer face frame 12 and the sign box 10. The sign box 10 contains a lighting source, typically lighting tubes T. The outer face frame 12 supports an outer sign face panel 16, and the intermediate support frame 14 supports an intermediate face panel 18. The face panel 18 may if desired carry information of a more-or-less permanent or long lasting nature, and the outer face panel 16 may be used to display information of a more rapidly changing nature. The outer panel 16 may be transparent in places, so as to reveal the information on the intermediate panel 18. Alternatively the outer panel 16 may simply be removable and replaceable over the top of the intermediate panel 18 so as to provide two different information messages at for example different times of day or different times of the week.

As stated above, one form of sign box construction is shown in U.S. Pat. No. 3,863,372, and certain of the portions of the sign box and face frame structure of the present invention, are designed with generally similar features.

It will of course be understood however that the present invention is not to be construed as being limited to the form of construction shown in U.S. Pat. No. 3,863,372. The present inventions are applicable to sign boxes of a wide variety of different constructions having different hinging formations, and other different features, the present form of construction being described simply for the sake of example.

Figure 2:
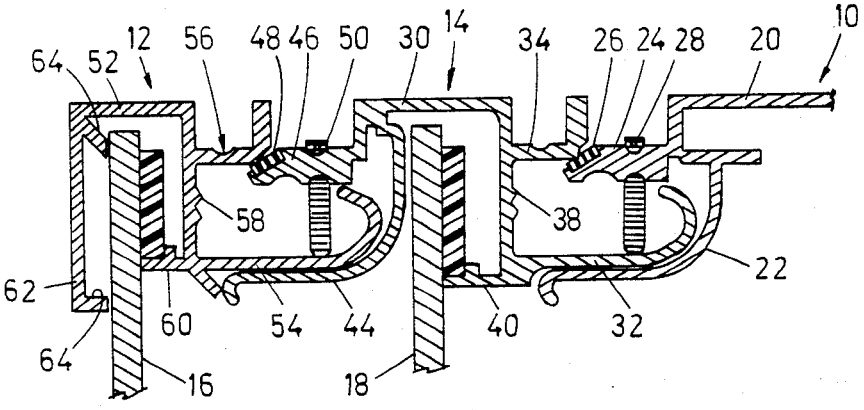
FIG. 2 is a section along the line 2—2 of FIG. 1.

Thus as shown in FIG. 2, the sign box 10 is shown generally as comprising a main wall 20, only a portion of which is shown for the sake of simplicity, and which is generally of the same design both on the top and bottom and opposite ends of the box. As described however it is not necessary that the wall 20 be of identical construction on all four sides of the box 10.

The outer wall 20 of sign box 10 is provided with a first hinging member which in this particular embodiment is illustrated by the generally concavely curved wall formation 22 extending downwardly and forwardly with respect of the main wall 20. A sealing wall 24 is also connected to the main wall 20, and extends forwardly therefrom spaced above the generally concave hinging member 22. It is provided with a sealing strip 26 formed of resilient material such as rubber, plastic and the like.

A retaining screw or other retaining member 28 extends through the wall 24 for purposes to be described below.

The intermediate face frame 14 will be seen to comprise an outer wall 30, having a first hinging portion 32 extending rearwardly therefrom. The first hinging portion 32 in this embodiment is illustrated in the form of a generally convexly curved hinging portion adapted to cooperate with the convex curvature of the first hinged member 22 of sign box 10. Intermediate frame 14 also has a first sealing wall portion 34 extending rearwardly, for interengagement with the sealing strip 26 of sealing wall 24.

A junction wall 38 extends in a generally L-shape from outer wall 30, and connects with convex member 32 and sealing wall 34. It has an inner retaining strip 40, shaped in a suitable manner to provide retaining means for the intermediate face panel 18. Panel 18 is held in position by any suitable means such as the retaining strip or wedge 42.

As noted above the intermediate face frame 14 is not only hingably mounted on the main sign box 10, but also provides a hinge mounting for the outer face frame 12.

For this purpose, and purely by way of example, it is provided with a second hinging member, in this case the concave wall formation 44 extending downwardly and forwardly from outer wall 30. Wall 44 is of the same shape and configuration as concave wall 22 of sign box 10.

Intermediate frame 14 also has second sealing wall means 46, supporting a suitable resilient sealing strip 48. Further retaining means illustrated generally as a retaining screw 50, are provided in the second sealing wall 46 for purposes to be described.

The outer face frame 12 comprises an outer main wall 52, and a second hinging portion for cooperation with the second hinging member of intermediate frame 14. In this case the second hinging portion comprises a generally convexly curved wall member 54 shaped to cooperate with the concavely shaped wall member 44 and provide hinging action. It will of course be understood however that the use of such concave and convexly shaped hinged means is illustrated purely by way of example, and is not to be regarded as limiting to hinging means of this particular shape or action. Other forms of hinging means are suitable, and may be substituted therefore without departing from the scope of the invention.

A second sealing wall 56 extends rearwardly from outer wall 52, for intergagement with the sealing strip 48.

A junction wall 58 is connected in a generally shaped manner to the outer wall 52, and connects with walls 56 and 54. A retaining strip 60 is also joined to wall 58, for assisting in retaining the outer face panel 16 in position.

An outer retaining wall 62 extends in a L-shaped manner from the forward edge of outer wall 52, and extends parallel with wall 58 to provide a generally recessed channel for reception of the edge of outer face panel 16 in the manner shown. Suitable retaining strips 64 are provided for cooperating with retaining strip 60 and securing the panel 16 in position.

In operation, the panel 18 may be provided, carrying one form of information, and the panel 16 may carry information which is complimentary to the information on panel 18, or may simply replace it.

In the majority of cases portions of panel 16 will be transparent so that panel 18 can be seen behind panel 16. In this way the information on panel 16 can vary the information on panel 18, or can simply complete gaps in the information on panel 18 as desired.

The assembly of the invention will consist essentially in first of all constructing and erecting the sign box 10 in position. The intermediate face frame 14 will then be placed in position by sliding the convex hinge member 32 inwardly over the surface of the concave hinge member 22. When the two are seated together as shown in FIG. 2, two or more retaining members 28 may be inserted so as to hold them in position. Members 28 are of such a nature that while they prevent the member 32 from may be swung forwardly and upwardly, giving access to the interior of sign box 10 for servicing and the like.

While only the top edge of such sign box 10 and intermediate frame 14 have been shown, it will be appreciated that the construction of the lower edge in this particular embodiment will be generally similar, as will be the construction of the two side edges.

For the sake of security further retaining members such as bolts or screws 28 may be inserted along the lower edge so as to secure the intermediate face frame 14 in position.

The outer face frame 12 is then connected, simply by sliding the convex member 54 inwardly over the concave member 44. When seated, retaining members such as screws 50 may then be inserted as shown. Similarly such screws 50 will prevent withdrawal of member 54 from member 44, but will permit upward hinging action of the entire frame 12 relative to the intermediate frame 14.

As before, if desired the lower edge can also be secured by similar screw 50.

It will thus be seen that by provision of the intermediate face frame having hinging formations adapted to cooperate with both the main sign box 10 and also the outer face frame 12, a much more flexible adaptable sign is provided having a wider range of use.

At the same time, in this embodiment of the invention the sign box 10 can be used without the intermediate face frame 14, simply by using the outer face frame 12, being hingagely connected directly to the sign box 10.

In accordance with a further embodiment of the invention, the sign face panel which is normally rigid, typically being an acrylic plastic material, may be replaced by a thin flexible plastic sign face material. Such thin flexible materials are less expensive, and are in certain circumstances easier to print, thereby making an economical sign having many of the features of the more expensive sign having a rigid face panel.

In order to do this, provision is made for attachment and retention of the thin sheet material around its edges so that it may be held secure and tight.

Figure 3:
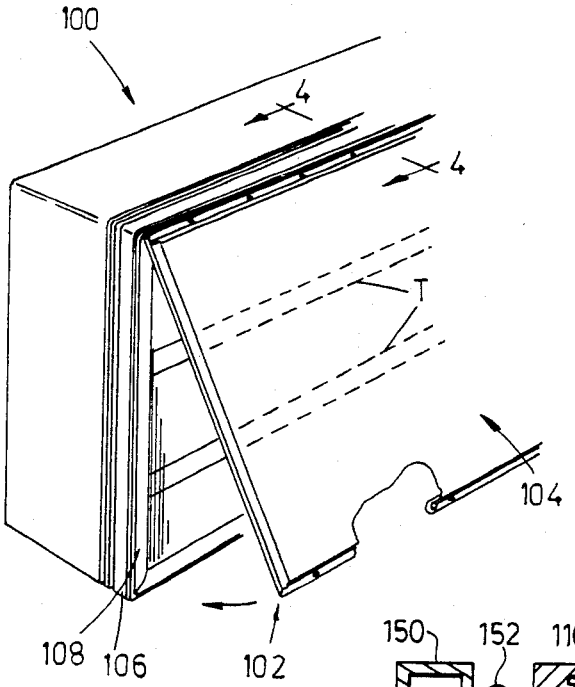
FIG. 3 is a perspective illustration of a further embodiment of the invention.

As best shown in FIG. 3 a sign box is illustrated generally as 100, having a face frame indicated as 102, carrying a thin flexible face panel 104. As before, suitable illumination is provided within sign box 100 for example by means of tubes T.

Figure 4:
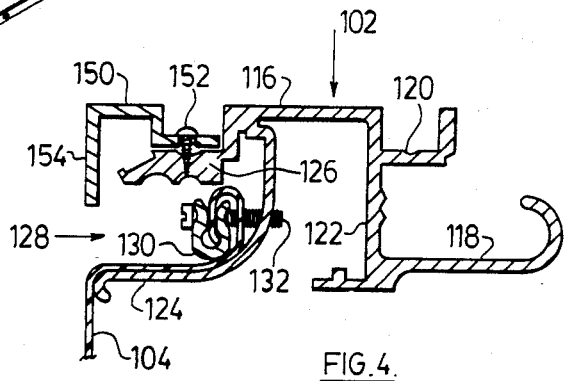
FIG. 4 is a section along the 4—4 of FIG. 3.

Referring now to FIGS. 3 and 4, it will be seen that the sign box 100 comprises a main outer wall 106, having any suitable hinging formation such as the generally concave wall 108, and having a sealing wall, a sealing strip and a retaining screw similar to FIG. 2.

As explained above, however, the use of such a concave hinging wall 108 is but one of different ways in which such a hinging action may be provided, and the sealing wall and strip may not always be necessary, depending upon the design of the particular form of hinge.

The face frame 102, for carrying the thin flexible panel 104 in this particular embodiment of the invention, is the same extrusion as that of the intermediate face frame 14 of FIG. 2. This however is simply a matter of convenience and economy, and as described below, other forms of face frame may be substituted for the face frame 102, while still providing effective support for the flexible panel 104.

Thus in the embodiment of FIG. 4, the face frame 102 comprises an outer wall 116, and a generally rearwardly directed hinging portion comprising the convex wall 118 shaped to interengage with the concave wall 108.

A sealing wall 120 is also provided for cooperation with the seal on sign box 100.

A junction wall 122 connects in a L-shaped fashion with wall 116, and provides support for hinge wall 118 and sealing wall 120.

A forwardly directed concave wall 124, and sealing wall 126 are provided, similar to walls 44 and 46 in the embodiment of FIG. 2, and define between them an elongated channel or recess 128 for reception of the edge of flexible panel 104.

Panel 104 is retained in recess 128 by means of the core member 130, and a series of retaining screws 132. Screws 132 pass through core member 130 at intervals and are threadedly engaged in a portion of the concave wall 124 as shown.

Figure 5:
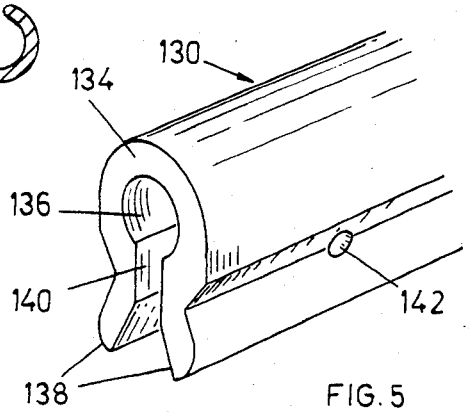
FIG. 5 is a perspective illustration of the core member for use with the FIG. 3 embodiment, and, FIG. 6 is a sectional illustration of an alternate embodiment for use in association with the FIG. 3 embodiment.

Core member 130 is shown in more detail in FIG. 5 and will be seen to consist of a generally semi-cylindical wall 134, having a generally semi-cylindrical hollow interior 136, and having two continuous outwardly divergent angled lips 138, defining a narrow elongated slit-like opening 140. A plurality of fastening holes 142 are provided therealong at intervals.

As best shown in FIG. 4, an edge portion of the flexible panel 104 may be slid into the open slit 140 and opening 136, and the core member 130 may then simply be wound up, so that the flexible sheet material 104 binds upon itself and cannot escape from the core 130.

The retaining screws 132 are then passed through the wound up material 104 and through holes 142 in core 130, and threaded into the concave wall 124 as shown. They can then be tightened up so as to apply tension to the material 104 somewhat in the manner of a drum skin.

As explained above, while the extrusion 102 is of the same shape as the extrusion 14 of FIG. 2, and thus provides an economy of useage for such extrusion, it may be that different extrusions can be used for achieving the purpose of supporting the flexible panel 104.

A cover member 150 may be fastened by screws 152 to the front sealing wall 126. Member 150 has a front face 154 partially closing off channel 128 to improve its appearance, and to avoid tampering, and weather damage.

Figure 6:
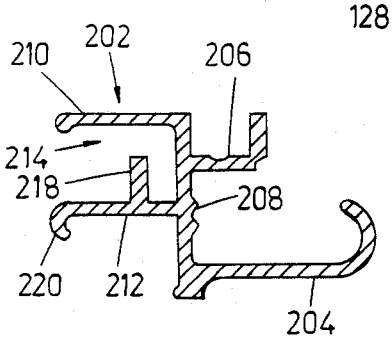

An example of such a different form of extrusion is shown in FIG. 6.

In this case, the face frame is shown generally as 202, and has a rearwardly extending hinge formation, in this case being shown as the convex wall 204 and a sealing wall 206, so that it is adapted to cooperate with the form of sign box 100 as shown in FIG. 3. As explained, however, it is not necessary for purposes of the invention that the invention be limited to the sign box 100, and other forms of sign box with other hinging means may be provided with or without sealing walls as desired.

A junction wall 208 connects hinging wall 204 and sealing wall 206. An outer main wall 210 connects to junction wall 208 in a generally L-shaped manner and extends forwardly.

A lower retaining wall 212 is also connected to junction wall 208 being spaced apart from outer wall 210 so as to define therebetween an elongated channel or recess 214. A fastening strip 218 is provided for the reception of fastening screws 132. In this way, it is possible to attach core member 130 in position.

Preferably the retaining wall 212 will have a generally rounded lip portion 220 so that the flexible material 104 may be tightened there around without cutting it.

Numerous other forms of face frame extrusion may also be suitable having different forms of hinge means, and different means of fastening and tightening the flexible panel 104. It will thus be seen that the invention provides both for the use of two different information panels 16 and 18, by means of an intermediate face frame and an outer face frame, and also provides for the use of a flexible face material 104, which may be fastened in position in a secure and efficient manner.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. An intermediate frame construction for use in association with a sign box of the type having a box hinge recess around its perimeter and a front frame for supporting a face panel, said front frame having a front hinge, said intermediate frame comprising;

a generally rectangular frame having two end members, and top and bottom members, joining one another at corners, each of said members having an outer wall;

face panel supporting means connected with said outer wall and extending inwardly, for supporting a face panel therein;

an intermediate hinge connected to said outer wall, and extending in a rearward direction for hinging interengagement with said box hinge recess in said sign box, and, wall means defining an intermediate hinge recess connected to said outer wall, and extending in a forward direction, and adapted to receive said front hinge carried on said front frame whereby such front frame is hingedly connected to such intermediate frame, and such intermediate frame is in turn hingedly connected to such sign box.

2. An intermediate frame as claimed in claim 1 wherein said wall means defining said intermediate hinge recess is connected to said outer wall, along a forwardly directed portion thereof, and including a generally L-shaped junction wall portion connected to said outer wall adjacent a rearwardly directed portion thereof, said intermediate hinge being connected to said L-shaped junction wall, whereby said intermediate hinge is inwardly offset with respect to said outer wall.

3. An intermediate frame as claimed in claim 2 wherein said intermediate hinge, and said wall means defining said intermediate hinge recess both comprise elongated, generally curved formations, having mating shapes with said intermediate hinge having a generally convex outer shape, and said intermediate hinge recess defining a generally concave inner surface.

4. An intermediate frame as claimed in claim 3 including retaining means on said sign box, interengageable with said intermediate hinge, for retaining same in said box hinge recess, and further retaining means associated with said outer wall of said intermediate frame, and being interengageable with said front hinge on said front frame, for retaining same in said intermediate hinge recess.

5. An intermediate frame as claimed in claim 4 including sealing means associated with said sign box adjacent said box hinge recess, and further sealing means associated with said intermediate hinge recess, both said recesses thereby being effectively sealed against the entrance of moisture, during adverse weather conditions.

6. An intermediate frame construction for use in association with a sign box of the type having a box hinge recess around its perimeter, and a front frame for supporting a face panel, said front frame having a front hinge, said intermediate frame comprising;

a generally rectangular frame having two end members, and top and bottom members, joining one another at corners, each of said members having an outer wall;

face panel supporting means connected with said outer wall and extending inwardly, said supporting means including a forwardly extending rim, said rim defining a forward edge;

an intermediate hinge connected to said outer wall, and extending in a rearward direction for hinging interengagement with said box hinge recess in said sign box;

wall means defining an intermediate hinge recess connected to said outer wall, and extending in a forward direction, and adapted to receive said front hinge carried on said front frame;

a sign face panel of generally thin, flexible material supported by said face panel supporting means;

holder means for engaging edges of said thin flexible material, and being received within said intermediate hinge recess, and, retaining means for adjustably securing said holder means at different distances from said rim, thereby tensioning said sign face material.

* * * * *